US011682377B2

(12) United States Patent
Kitazawa

(10) Patent No.: US 11,682,377 B2
(45) Date of Patent: Jun. 20, 2023

(54) SOUND PROCESSING APPARATUS, CONTROL METHOD, AND RECORDING MEDIUM

(71) Applicant: CANON KABUSHIKI KAISHA, Tokyo (JP)

(72) Inventor: Kyohei Kitazawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/686,203

(22) Filed: Mar. 3, 2022

(65) Prior Publication Data

US 2022/0310054 A1 Sep. 29, 2022

(30) Foreign Application Priority Data

Mar. 24, 2021 (JP) ..... JP2021-050221

(51) Int. Cl.
*G10K 11/178* (2006.01)

(52) U.S. Cl.
CPC .. *G10K 11/17854* (2018.01); *G10K 11/17823* (2018.01); *G10K 11/17873* (2018.01); *G10K 2210/3023* (2013.01); *G10K 2210/3027* (2013.01); *G10K 2210/3028* (2013.01)

(58) Field of Classification Search
None
See application file for complete search history.

(56) References Cited

U.S. PATENT DOCUMENTS

2018/0012585 A1* 1/2018 Qiao ..... G10L 21/0224
2018/0102123 A1* 4/2018 Tisch ..... G10K 11/178

FOREIGN PATENT DOCUMENTS

JP H06253387 A 9/1994

* cited by examiner

*Primary Examiner* — Kenny H Truong
(74) *Attorney, Agent, or Firm* — Canon U.S.A., Inc. IP Division

(57) ABSTRACT

A sound processing apparatus includes a first microphone which acquires environmental sound, a second microphone which acquires sound of a noise source, and a CPU which causes the sound processing apparatus to function as a noise detection unit configured to generate a noise signal of the noise source according to a sound signal from the second microphone, the noise detection unit reducing sound other than noise of the noise source from the sound signal from the second microphone and generating the noise signal, and a noise reducing unit configured to reduce the noise of the noise included in a sound signal from the first microphone using the sound signal from the noise detection unit.

14 Claims, 6 Drawing Sheets

SOUND PROCESSING APPARATUS, CONTROL METHOD, AND RECORDING MEDIUM

BACKGROUND

Field of the Disclosure

The present disclosure relates to a sound processing apparatus capable of reducing noise.

Description of the Related Art

A camera is capable of executing processing of reducing noise generated inside a housing using a microphone installed inside the housing. Japanese Patent Application Laid-Open No. H06-253387 discusses a video camera that picks up sound of noise generated inside a housing with a microphone arranged inside the housing, and that reduces noise with the microphone that picks up sound related to a subject based on sound signals generated by the microphone.

However, the sound signals generated by the microphone arranged inside the housing of the camera include, other than noise signals from the inside of the housing, signals generated from a location other than the inside of the housing and sound signals, such as signals of the microphone's self-noise and signals of sound from the outside of the housing. For this reason, sound signals generated by the microphone inside the housing become sound signals having amplitude that is larger than that of noise generated inside the housing. In a case where the camera performs noise reduction processing using sound signals generated by the microphone inside the housing, there is a possibility of excessively reducing sound from the subject and the like, resulting in degradation of sound quality.

SUMMARY

A sound processing apparatus includes a first microphone which acquires environmental sound, a second microphone which acquires sound of a noise source, and a CPU which causes the sound processing apparatus to function as a noise detection unit configured to generate a noise signal of the noise source according to a sound signal from the second microphone, the noise detection unit reducing sound other than noise of the noise source from the sound signal from the second microphone and generating the noise signal, and a noise reducing unit configured to reduce the noise of the noise included in a sound signal from the first microphone using the sound signal from the noise detection unit.

Further features of the present disclosure will become apparent from the following description of exemplary embodiments with reference to the attached drawings.

DESCRIPTION OF THE EMBODIMENTS

Exemplary embodiments of the present disclosure will be described below with reference to the accompanying drawings. The following exemplary embodiments do not limit the present disclosure, and all combinations of features described in the exemplary embodiments are not necessarily essential to a means for solving the issues of the present disclosure. The same components are denoted by the same reference signs and described.

Figure 1:
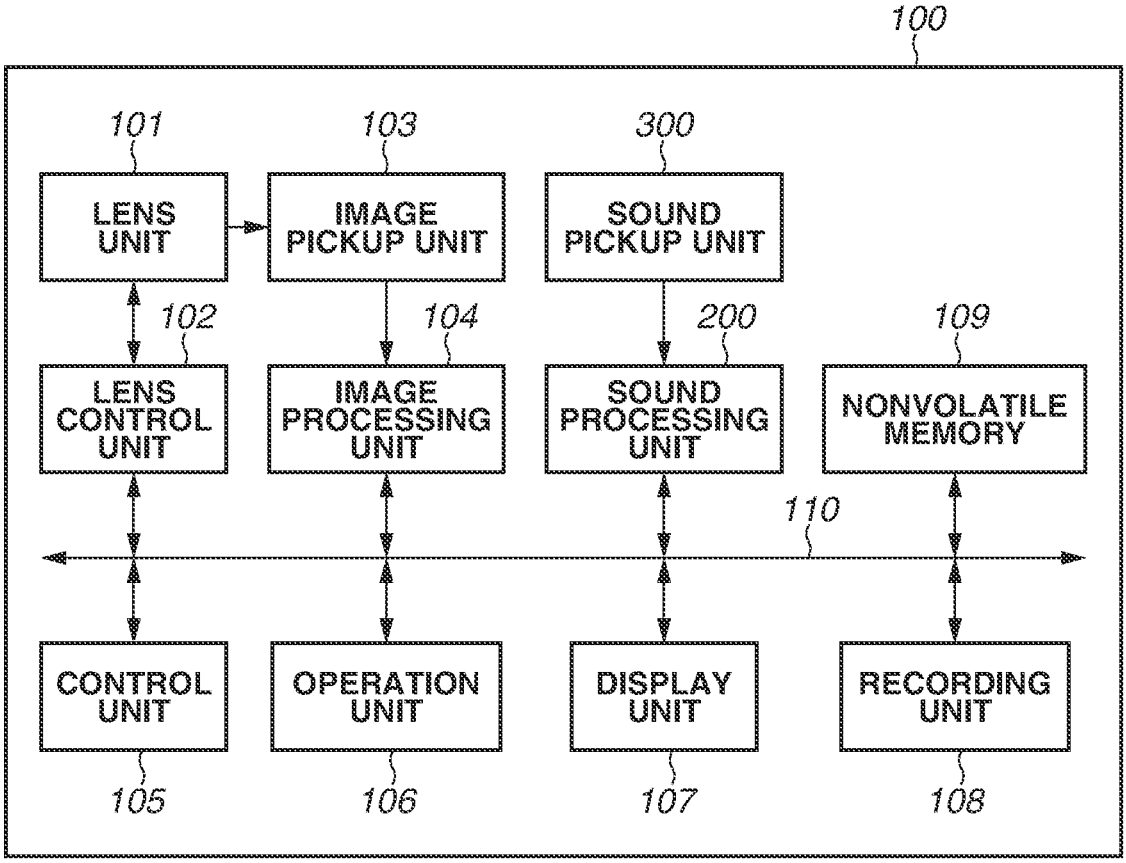
FIG. 1 is an example of a block diagram illustrating an image pickup apparatus according to one or more aspects of the present disclosure.

FIG. 1 is a block diagram illustrating an example of a configuration of an image pickup apparatus 100, which is an example of a sound processing apparatus according to a first exemplary embodiment. The image pickup apparatus 100 according to the present exemplary embodiment includes a lens unit 101, a lens control unit 102, an image pickup unit 103, an image processing unit 104, a control unit 105, an operation unit 106, a display unit 107, a recording unit 108, a sound processing unit 200, and a sound pickup unit 300.

The lens unit 101 is a lens unit. The lens unit 101 is, for example, a zoom lens or a varifocal lens. The lens unit 101 includes an optical lens, a motor for driving the optical lens, and a communication unit that communicates with the lens control unit 102 of the image pickup apparatus 100, which will be described below. The lens unit 101 is capable of focusing on and zooming in on/out from a subject and performing image stabilization by moving the optical lens with the motor based on a control signal received by the communication unit.

The lens control unit 102 transmits a control signal to the lens unit 101 based on data output from the image processing unit 104, which will be described below, and a control signal output from the control unit 105, which will be described below, and controls the lens unit 101.

The image pickup unit 103 includes an image pickup device for converting an optical image of a subject formed on an image pickup plane via the lens unit 101 to electric signals, and outputs the electric signals generated by the image pickup device to the image processing unit 104. The image pickup device is, for example, a charge-coupled device (CCD) or a complementary metal-oxide semiconductor (CMOS) device.

The image processing unit 104 generates image data or moving image data from the electric signals input from the image pickup unit 103. In the present exemplary embodiment, a sequence of processing of generating image data including still image data or moving image data in the image pickup unit 103 and the image processing unit 104, and outputting the image data from the image pickup unit 103 is referred to as "image capturing". In the image pickup apparatus 100, image data is recorded in the recording unit 108, which will be described below, in conformity with a Design rule for Camera File system (DCF) standard.

The control unit 105 controls each unit of the image pickup apparatus 100 via a data bus 110 based on input signals and a program, which will be described below. The control unit 105 includes a central processing unit (CPU) for executing various kinds of control, a read-only memory (ROM), and a random-access memory (RAM). Instead of control of the entire image pickup apparatus 100 by the control unit 105, a plurality of hardware devices may share the load of controlling the entire image pickup apparatus 100. A program for controlling each component is stored in the ROM of the control unit 105.

The RAM of the control unit 105 is a volatile memory utilized for performing arithmetic processing and the like.

The operation unit 106 is a user interface for accepting an instruction to the image pickup apparatus 100 from a user. The operation unit 106 includes a power switch for powering ON/OFF the image pickup apparatus 100, a release switch for giving an instruction for capturing an image, a reproducing button for giving an instruction for reproducing image data or moving image data, and a switch for switching an image capturing mode.

The display unit 107 displays image data output from the image processing unit 104, characters for a dialogic operation, a menu screen, and the like. When still-images are captured or when moving images are captured, the display unit 107 sequentially displays digital data output from the image processing unit 104, and can thereby function as an electronic viewfinder. The display unit 107 is, for example, a liquid crystal display or an organic electroluminescence (EL) display.

The recording unit 108 can record and read out data. For example, the control unit 105 can record and read out still image data, moving image data, and sound data from the recording unit 108. The recording unit 108 is, for example, a Secure Digital (SD) card, a CompactFlash (CF) card, an XQD memory card, a hard disk drive (HDD) (magnetic disk), an optical disk, or a semiconductor memory. The recording unit 108 may be configured so that it can be detachably attached to the image pickup apparatus 100, or may be incorporated in the image pickup apparatus 100. That is, the control unit 105 is only required to include at least a means for accessing the recording unit 108.

A nonvolatile memory 109 is a nonvolatile memory and stores therein a program and the like. The program, which will be described below, is executed by the control unit 105. Sound data is recorded in the nonvolatile memory 109. The sound data is, for example, in-focus sound to be output when the image pickup apparatus 100 focuses on a subject, electronic shutter sound to be output when image capturing is instructed, and electronic sound such as operation sound to be output when the image pickup apparatus 100 is operated.

The data bus 110 is a data bus for transmitting various kinds of data such as sound data, moving image data, and image data, and various kinds of control signals to each block of the image pickup apparatus 100.

Figure 2A:
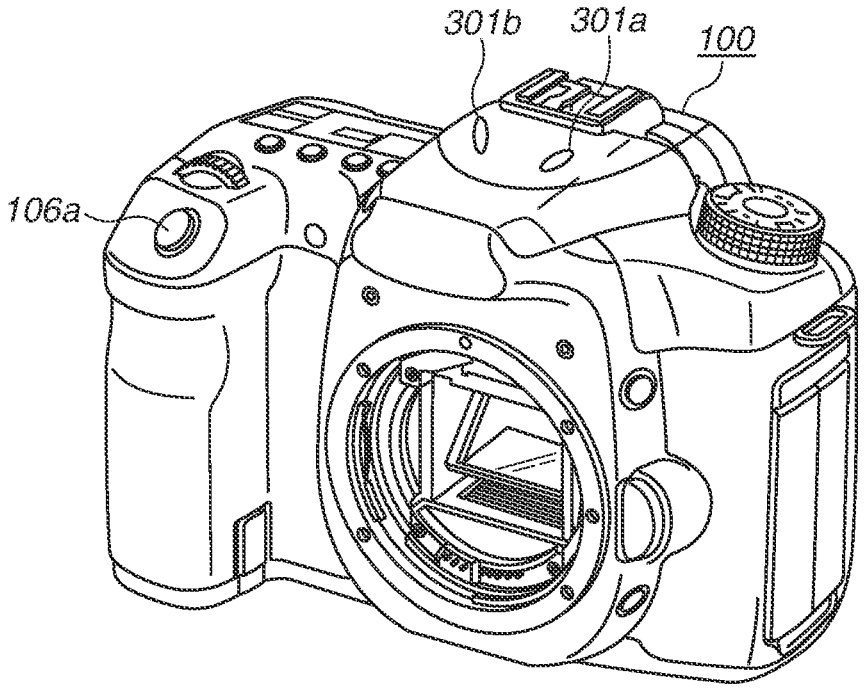
FIGS. 2A and 2B are an example of an external view illustrating the image pickup apparatus according to one or more aspects of the present disclosure.
Figure 2B:
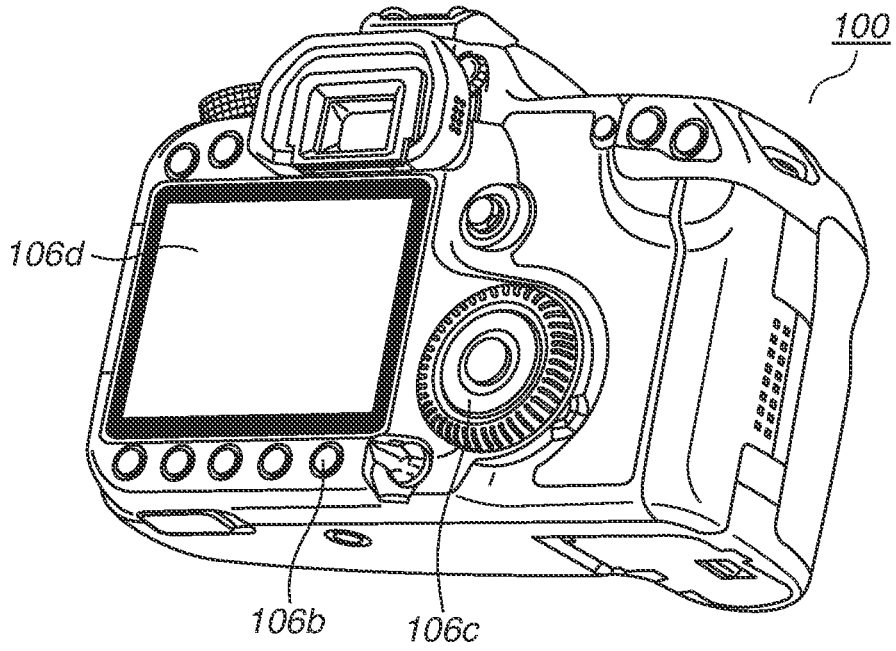

An example of an outer appearance of the image pickup apparatus 100 is to be described. FIG. 2A is an example of an external view illustrating the front side of the image pickup apparatus 100. FIG. 2B is an example of an external view illustrating the back side of the image pickup apparatus 100. A release switch 106*a*, a reproducing button 106*b*, a mode dial 106*c*, and a touch panel 106*d* are operation members included in the above-mentioned operation unit 106.

The release switch 106*a*, the reproducing button 106*b*, the mode dial 106*c*, and the touch panel 106*d* are operation means for inputting various kinds of operation instructions to the control unit 105. A still image, a moving image, or the like is displayed on the display unit 107. An L microphone 301*a* and an R microphone 301*b* are microphones for picking up sound such as a user's voice. When viewed from the back side of the image pickup apparatus 100, the L microphone 301*a* is arranged on the left side and the R microphone 301*b* is arranged on the right side.

The sound processing unit 200 and the sound pickup unit 300 will be described with reference to FIGS. 3 and 4.

The sound pickup unit 300 is now described. The sound pickup unit 300 includes a microphone for external sound 301 and a noise reference microphone 302. The microphone for external sound 301 and the noise reference microphone 302 are each an omnidirectional microphone.

The microphone for external sound 301 is a microphone for mainly picking up sound outside a housing of the image pickup apparatus 100 (i.e., environmental sound). The microphone for external sound 301 generates a sound signal from the picked-up environmental sound. In the present exemplary embodiment, the microphone for external sound 301 includes two microphones including the L microphone 301*a* and the R microphone 301*b*. In the present exemplary embodiment, the image pickup apparatus 100 picks up the environmental sound with the L microphone 301*a* and the R microphone 301*b*, and records sound signals, which are generated by the L microphone 301*a* and the R microphone 301*b*, in a stereo system. For example, the environmental sound is sound generated outside the housing of the image pickup apparatus 100 and outside a housing of the optical lens, such as the user's voice, animal call, sound of falling rain, and music. A hole for facilitating input of environmental sound into a microphone is arranged in the housing in the neighborhood of the microphone for external sound 301, as illustrated in FIG. 2.

The noise reference microphone 302 is a microphone for acquiring noise such as driving sound generated inside the housing of the image pickup apparatus 100 or in the lens unit 101 from a predetermined noise source. The noise reference microphone 302 generates sound signals from the picked up noise or the like. In the present exemplary embodiment, the noise reference microphone 302 is arranged to be shielded from the outside by an exterior package so as to reduce pickup of sound other than noise. The noise source is, for example, a driving unit, such as a motor of the lens unit 101 and a motor for driving a mirror inside the housing of the image pickup apparatus 100. The motor is, for example, an ultrasonic motor (hereinafter referred to as USM), and a stepping motor (hereinafter referred to as STM).

Noise is, for example, driving sound generated by driving of the motor such as the USM and the STM. For example, the motor performs driving in auto focus (AF) processing for focusing on a subject. In the present exemplary embodiment, the noise reference microphone 302 is arranged in the neighborhood of the lens unit 101, which is a main noise source of the image pickup apparatus 100.

Figure 3:
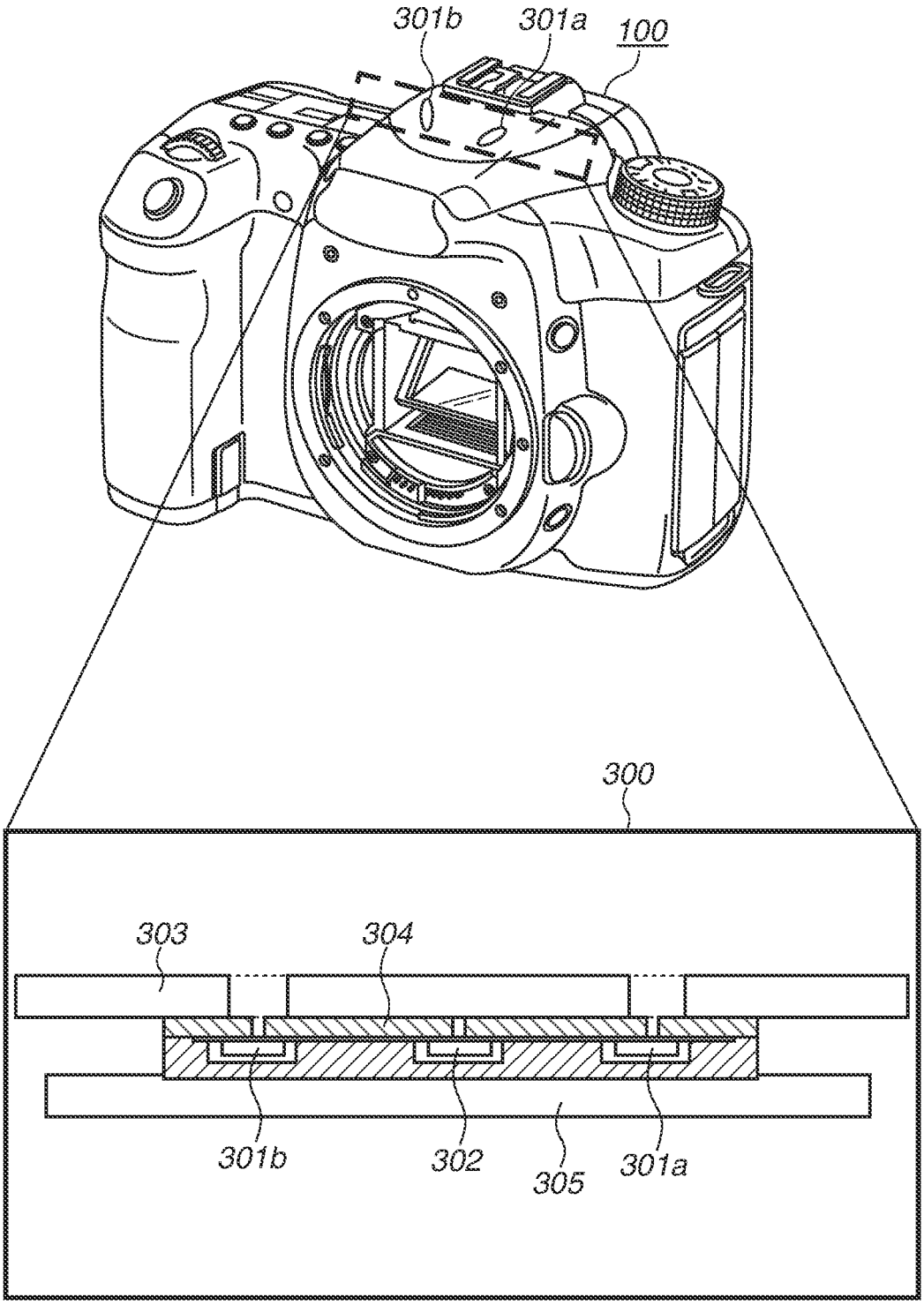
FIG. 3 is a diagram illustrating an example of arrangement of a sound pickup unit according to one or more aspects of the present disclosure.
Figure 4:
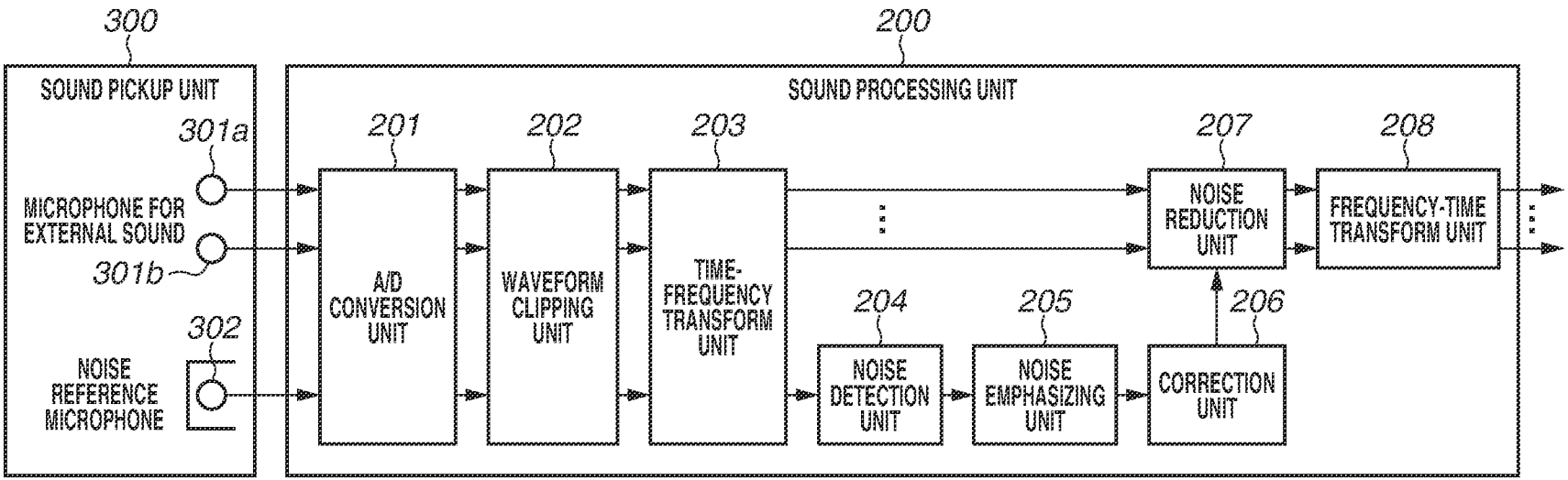
FIG. 4 is an example of a block diagram illustrating a sound processing unit and the sound pickup unit according to one or more aspects of the present disclosure.

FIG. 3 is an example of a sectional view of a portion of the image pickup apparatus 100 to which the L microphone 301*a*, the R microphone 301*b*, and the noise reference microphone 302 are attached. The image pickup apparatus 100 includes an exterior package unit 303, a microphone bush 304, and a fixing portion 305.

The exterior package unit 303 includes a hole for inputting the environmental sound to a microphone. In the present exemplary embodiment, respective holes are formed above the L microphone 301*a* and the R microphone 301*b*. On the other hand, the noise reference microphone 302 is arranged to acquire driving sound generated inside the housing of the image pickup apparatus 100 or inside the housing of the optical lens, without the need for acquiring the environmental sound. Hence, in the present exemplary embodiment, a hole is not formed above the noise reference microphone 302 in the exterior package unit 303. In the present exemplary embodiment, the hole formed in the exterior package unit 303 has an ellipse shape, but may have another shape such as a circular shape and a square shape. The holes above the L microphone 301*a* and the hole above the R microphone 301*b* may have shapes different from each other.

The microphone bush 304 is a member for fixing the L microphone 301*a*, the R microphone 301*b*, and the noise reference microphone 302. The fixing portion 305 is a member for fixing the microphone bush 304 to the exterior package unit 303.

In the present exemplary embodiment, the exterior package unit 303 and the fixing portion 305 are made of a mold member such as a polycarbonate (PC) material. The exterior package unit 303 and the fixing portion 305 may be made of a metal member such as aluminum and stainless steel. In the present exemplary embodiment, the microphone bush 304 is made of a rubber material such as ethylene propylene diene rubber.

The sound processing unit 200 is now described with reference to FIG. 4. For example, the sound processing unit 200 is an integrated circuit (IC) chip that is dedicated to signal processing on sound signals. The sound processing unit 200 is controlled by the control unit 105 to perform signal processing on sound signals. The sound processing unit 200 includes an analog/digital (A/D) conversion unit 201, a waveform clipping unit 202, a time-frequency transform unit 203, a noise detection unit 204, a noise emphasizing unit 205, a correction unit 206, a noise reduction unit 207, and a frequency-time transform unit 208.

The A/D conversion unit 201 converts an analog sound signal input from the microphone for external sound 301 or the noise reference microphone 302 to a digital sound signal. The A/D conversion unit 201 outputs the converted digital sound signal to the waveform clipping unit 202. In the present exemplary embodiment, the A/D conversion unit 201 executes sampling processing with a sampling frequency of 48 kHz and a bit depth of 16 bits to convert the analog sound signal to the digital sound signal. The digital sound signal output from the A/D conversion unit 201 is a digital sound signal in a time domain.

The waveform clipping unit 202 clips out digital sound signals input from the A/D conversion unit 201 into a predetermined length, and outputs the clipped digital sound signals to the time-frequency transform unit 203. The predetermined length is hereinafter referred to as a frame. In the present exemplary embodiment, the waveform clipping unit 202 clips out 1024 samples of sound signals as sound signals in one frame. Additionally, the waveform clipping unit 202 clips out the digital sound signals in the one frame by temporally shifting a target of clipping for each 512 samples.

That is, in the present exemplary embodiment, the waveform clipping unit 202 performs so-called half-overlap processing. The waveform clipping unit 202 performs windowing processing using a Hanning window on the clipped digital sound signals in one frame. The sound signals output from the waveform clipping unit 202 are subsequently subjected to sound signal processing on a frame-by-frame basis. In the present exemplary embodiment, the waveform clipping unit 202 uses the Hanning window as a window function in the windowing processing, but may use a freely-selected window function, such as a Hamming window and a Gauss window, instead of the Hanning window.

The time-frequency transform unit 203 performs Fourier transform processing on digital sound signals in a time domain, which are input from the waveform clipping unit 202, and transforms the digital sound signals in the time domain to digital sound signals in a frequency domain. In the present exemplary embodiment, the time-frequency transform unit 203 performs fast Fourier transform processing on the digital sound signals. The digital sound signals in the frequency domain are hereinafter also referred to as sound spectrum signals. Sound spectrum signals generated from sound acquired with the microphone for external sound 301 are output to the noise reduction unit 207. On the other hand, sound spectrum signals generated from sound acquired with the noise reference microphone 302 are output to the noise detection unit 204 and the noise emphasizing unit 205. In the present exemplary embodiment, the sound spectrum signals have a frequency spectrum of 1024 points in a frequency band from 0 Hz to 48 kHz. The sound spectrum signals have a frequency spectrum of 513 points in a frequency band from 0 Hz to 24 kHz, which is a Nyquist frequency. In the present exemplary embodiment, the image pickup apparatus 100 performs noise reduction processing utilizing sound data having the frequency spectrum of 513 points from 0 Hz to 24 kHz, out of sound data output from the time-frequency transform unit 203.

The noise detection unit 204 performs processing of detecting noise from the sound spectrum signals input from the time-frequency transform unit 203. In the present exemplary embodiment, the noise detection unit 204 determines whether noise is included in the input sound spectrum signals on a frame-by-frame basis. A frame determined to include noise therein is hereinafter referred to as a frame in a noise section, and a frame determined to include no noise therein is hereinafter referred to as a frame in a non-noise section. In the present exemplary embodiment, the noise detection unit 204 performs the processing of detecting noise as follows. The noise detection unit 204 calculates an average value of differences in corresponding frequencies of the frequency spectrum between audio spectrum signals in the frame in the non-noise section and audio spectrum signals in the clipped frame. In a case where the calculated average value exceeds a predetermined threshold, the noise detection unit 204 determines the clipped frame as the frame in the noise section. In this manner, the noise detection unit 204 detects a period in which noise is generated from the noise source. In the present exemplary embodiment, the noise detection unit 204 can detect long-term noise that attributes to an operation of the driving unit as the noise source and that continues for a certain period of time, and short-term noise that is generated before and after the long-term noise. The long-term noise is, for example, sliding noise within the housing of the optical lens. The short-term noise is, for example, noise generated by engagement of gears in the optical lens. The reason that the noise detection unit 204 determines the long-term noise and the short-term noise to be different from each other is that the image pickup apparatus 100 performs noise reduction processing based on frequency characteristics that are different depending on noise. The noise detection unit 204 outputs a detection result to the noise emphasizing unit 205.

The noise emphasizing unit 205 performs processing of emphasizing noise included in sound spectrum signals input from the time-frequency transform unit 203 with respect to the frame determined as the frame in the noise section by the noise detection unit 204. The sound spectrum signals emphasized by the noise emphasizing unit 205 are corrected by the correction unit 206. The noise reduction unit 207 subtracts the corrected sound spectrum signals from sound spectrum signals generated from sound signals input from the microphone for external sound 301. Processing of the correction unit 206 and processing of the noise reduction unit 207 will be described in detail below. In the present exemplary embodiment, the noise emphasizing unit 205 suppresses the microphone's self-noise mixed into the noise reference microphone 302, and thereby emphasizes noise generated by driving of a lens of the lens unit 101. The noise generated by driving of the lens of the lens unit 101 is hereinafter also referred to as lens driving noise. Specific processing of the noise emphasizing unit 205 is now described.

The reason for suppressing the self-noise is described. In comparison of a frequency band of the microphone's self-noise and a frequency band of the lens driving noise, the amplitude of the lens driving noise can be divided into the following two regions. One of the regions is a frequency band in which the amplitude of the lens driving noise is equal to or greater than a predetermined value with respect to the amplitude of the self-noise. The other of the regions is a frequency band in which the amplitude of the lens driving noise is less than the predetermined value with respect to the amplitude of the self-noise. That is, in the latter region, a degree of loudness of the lens driving noise and that of the self-noise are about the same. Hence, noise in the former frequency band is heard as main noise by a user.

For this reason, when the noise reduction processing is to be performed, the image pickup apparatus 100 needs to perform noise reduction processing to sufficiently reduce the lens driving noise in the former frequency band. Nevertheless, sound included in the former frequency band naturally includes self-noise, too. Thus, there are sound spectrum signals having amplitude that is greater than that of sound spectrum signals of actual lens driving noise in the former frequency band. If the image pickup apparatus 100 performs the noise reduction processing to sufficiently reduce the lens driving noise in the former frequency band based on such sound spectrum signals, there is a possibility for excessively reducing even the amplitude of sound signals included in the latter frequency band. In this case, the sound signals in which noise is reduced becomes sound signals including uncomfortable sound such as sound with degraded sound quality and sound that gives the feeling of discontinuity.

To address the above issue, in the present exemplary embodiment, the noise emphasizing unit 205 performs processing of suppressing amplitude of stationary noise that is not correlated to the lens driving noise like the self-noise, and thereby performs noise reduction processing that can prevent degradation of sound quality and the like while reducing the lens driving noise. The stationary noise that is not correlated to the lens driving noise includes, other than the self-noise, background noise and leaked sound of stationary environmental sound. In the present exemplary embodiment, the noise emphasizing unit 205 uses, for example, a Wiener filter defined by the expression (1) in the suppression processing.

$$WF(f)=N\mathrm{Ref}_{enh}(f-1)/\{N\mathrm{Ref}_{enh}(f-1)+N\mathrm{Ref}_{sn}\} \quad (1)$$

The noise emphasizing unit 205 performs calculation defined by the expression (2) using the above-described Wiener filter to perform the suppression processing.

$$N\mathrm{Ref}_{enh}(f)=WF(f)*N\mathrm{Ref}(f) \quad (2)$$

In this expression, f represents a frame number, WF(f) represents a Wiener filter coefficient, $\mathrm{NRef}_{enh}$(f) represents amplitude of a sound spectrum signal output from the noise emphasizing unit 205, and NRef(f) represents amplitude of a sound spectrum signal input from the time-frequency transform unit 203. $\mathrm{NRef}_{sn}$ represents amplitude of a sound spectrum signal of the self-noise included in sound spectrum signals input from the noise reference microphone 302. $\mathrm{NRef}_{sn}$ represents data preliminarily measured in a state where the lens driving noise is not generated.

As described above, the Wiener filter is a filter used for reducing the stationary noise that is not correlated to main sound, such as the self-noise. The Wiener filter in the expression (1) is formulated such that sound corresponding to the main sound becomes a sound signal of the lens driving noise, and sound corresponding to the stationary noise that is not correlated to the main sound becomes a sound signal of the self-noise. The noise emphasizing unit 205 applies the Wiener filter to sound signals from the noise reference microphone 302, and can thereby reduce sound other than the lens driving noise from sound signals of sound picked up by the noise reference microphone 302. Especially, sound detected as the long-term noise by the noise detection unit 204 like the self-noise is sound of a type that can be effectively reduced by the Wiener filter.

As described above, the noise emphasizing unit 205 reduces sound other than noise generated from the noise source to generate sound signals that are close to signals of noise itself generated from the noise source. In the present exemplary embodiment, the noise emphasizing unit 205 uses the Wiener filter to generate sound spectrum signals in which the stationary noise not correlated to the lens driving noise, such as the self-noise, is suppressed and that are close to signals of the lens driving noise itself. With this processing, the noise emphasizing unit 205 can generate sound spectrum signals in which the lens driving noise is relatively emphasized. The image pickup apparatus 100 uses the sound spectrum signals that are close to the signals of the lens driving noise itself, and can thereby reduce the lens driving noise included in the sound spectrum signals from the microphone for external sound 301 and also prevent excessive reduction of sound other than the lens driving noise. In other words, the image pickup apparatus 100 uses the sound spectrum signals generated by the noise emphasizing unit 205, and can thereby perform the noise reduction processing that can prevent degradation of sound quality and the like while reducing the lens driving noise. The noise emphasizing unit 205 performs processing of reducing the self-noise only in a section that is determined as the noise section in the noise detection unit 204. The processing of reducing the self-noise may be performed on each of different types of noise detected by the noise detection unit 204. The noise emphasizing unit 205 outputs the sound spectrum signals subjected to the suppression processing to the correction unit 206.

The correction unit 206 corrects sound spectrum signals input from the noise emphasizing unit 205. The correction unit 206 corrects the sound spectrum signals input from the noise emphasizing unit 205 so that the sound spectrum signals are close to the sound spectrum signals of the lens driving noise included in the microphone for external sound 301. The reason that the correction processing is necessary is that sound signals generated from identical lens driving noise are different between the microphone for external sound 301 and the noise reference microphone 302. This is because a hole is arranged in the neighborhood of the microphone for external sound 301, while the noise reference microphone 302 is arranged so as to be shielded from the outside by the exterior package. In the present exemplary embodiment, the correction unit 206 uses a preliminarily recorded correction coefficient so that the sound spectrum signals input from the noise emphasizing unit 205 are close to noise components included in the sound signals input from the microphone for external sound 301. The correction coefficient is recorded in the nonvolatile memory 109. In the present exemplary embodiment, the correction unit 206 multiplies the sound spectrum signals input from the noise emphasizing unit 205 by the correction coefficient. The correction unit 206 outputs the sound spectrum signals corrected with the correction coefficient to the noise reduction unit 207.

The noise reduction unit 207 reduces noise in the sound spectrum signals that are generated by the microphone for external sound 301 and that are input from the time-frequency transform unit 203 using the sound spectrum signals input from the correction unit 206. In the present exemplary embodiment, the noise reduction unit 207 reduces noise using the Wiener filter. The noise reduction unit 207 outputs the sound spectrum signals in which noise is reduced to the frequency-time transform unit 208.

The frequency-time transform unit 208 performs inverse Fourier transform processing on the sound spectrum signals input from the noise reduction unit 207, and transforms the sound spectrum signals to sound signals in a time domain. The frequency-time transform unit 208 uses half-overlap, that is, adds a result of the processing in a present frame to a result of the processing in the former frame while temporally shifting a target of the processing by half of one frame length to output the sound signals in the time domain. The output sound signals are recorded in the recording unit 108 by the control unit 105. In a case of a moving-image recording mode, the control unit 105 generates moving image data from image signals from the image processing unit 104 and sound signals from the frequency-time transform unit 208, and records the moving image data in the recording unit 108.

<Sound Record Processing>

Figure 5:
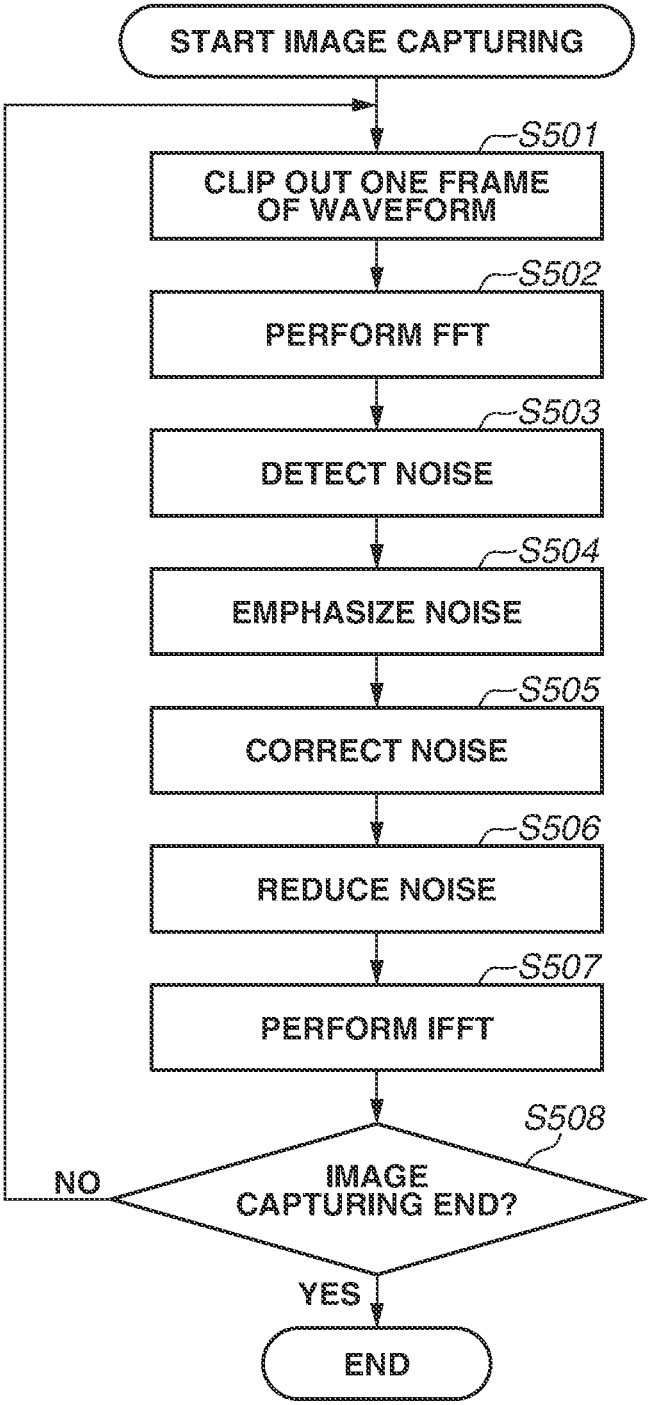
FIG. 5 is a flowchart describing an example of processing of the sound processing unit according to one or more aspects of the present disclosure.

Sound record processing of the image pickup apparatus 100 according to the present exemplary embodiment is now described with reference to FIG. 5. FIG. 5 is a flowchart describing sound record processing according to the present exemplary embodiment. The processing described in the flowchart is executed by the control unit 105 of the image pickup apparatus 100 controlling the sound processing unit 200 based on input signals and a program. The processing described in the flowchart is started, for example, in response to the operation unit 106 accepting an instruction for starting to record moving images or an instruction for starting to record sound from a user.

In step S501, the sound processing unit 200 uses the waveform clipping unit 202 to clip out one frame of a waveform from digital sound signals output from the A/D conversion unit 201.

In step S502, the sound processing unit 200 uses the time-frequency transform unit 203 to perform fast Fourier transformation (FFT) on the digital sound signals generated by the waveform clipping unit 202. The sound processing unit 200 uses the time-frequency transform unit 203 to generate sound spectrum signals from digital sound signals acquired with the microphone for external sound 301. The sound spectrum signals are utilized by the noise reduction unit 207. The sound processing unit 200 uses the time-frequency transform unit 203 to generate sound spectrum signals from digital sound signals acquired with the noise reference microphone 302. The sound signals are utilized by the noise detection unit 204 and the noise emphasizing unit 205.

In step S503, the sound processing unit 200 uses the noise detection unit 204 to perform processing of detecting noise from the sound spectrum signals generated by the time-frequency transform unit 203.

In step S504, the sound processing unit 200 uses the noise emphasizing unit 205 to perform processing of emphasizing noise included in the sound spectrum signals generated by the time-frequency transform unit 203 with respect to the frame determined as the frame in the noise section by the noise detection unit 204.

In step S505, the sound processing unit 200 uses the correction unit 206 to correct the sound spectrum signals generated by the noise emphasizing unit 205.

In step S506, the sound processing unit 200 uses the noise reduction unit 207 to reduce noise in the sound spectrum signals generated by the time-frequency transform unit 203 using the sound spectrum signals generated by the correction unit 206.

In step S507, the sound processing unit 200 uses the frequency-time transform unit 208 to perform inverse fast Fourier transform (IFFT) processing on the sound spectrum signals generated by the noise reduction unit 207. The transformed signals are sequentially recorded in the recording unit 108 by the control unit 105.

In step S508, the control unit 105 determines whether to end image capturing. For example, in a case where a release switch is pressed by the user, the control unit 105 determines to end the image capturing. In a case where the control unit 105 determines to end the image capturing (YES in step S508), a series of processing of the flowchart ends. In a case where the control unit 105 determines not to end the image capturing (NO in step S508), the processing in step S501 is executed. That is, the processing from steps S501 to S507 is repeated until the user performs an operation of instructing the end of the image capturing.

The sound record processing of the image pickup apparatus 100 has been described above. Accordingly, the image pickup apparatus 100 can perform the noise reduction processing that enables prevention of degradation of sound quality and the like while reducing lens driving noise.

The sound processing unit 200 uses the noise detection unit 204 to detect the noise section based on the sound spectrum signals in the present exemplary embodiment, but may acquire control information about the driving unit that is the source of noise and detect noise based on the control information. For example, the sound processing unit 200 may use the noise detection unit 204 to acquire a control signal for driving a lens from the lens control unit 102 and detect noise based on the control signal.

The sound processing unit 200 may use the noise detection unit 204 to detect the noise section using sound spectrum signals generated from sound acquired with the microphone for external sound 301.

The noise emphasizing unit 205 and the noise reduction unit 207 perform the suppression processing using the Wiener filter in the present exemplary embodiment, but another noise reduction method may be used. Examples of the other noise reduction method include a spectrum subtraction method (SS method). In the noise reduction by the SS method, for example, the sound processing unit 200 uses the noise emphasizing unit 205 to subtract sound spectrum signals for reducing the self-noise recorded in the nonvolatile memory 109 from sound spectrum signals generated by the time-frequency transform unit 203. For example, in the noise reduction by the SS method, the sound processing unit 200 uses the noise reduction unit 207 to subtract sound spectrum signals input from the correction unit 206 from sound spectrum signals that are generated by the microphone for external sound 301 and that are input from the time-frequency transform unit 203. In the SS method, non-stationary sound like sound generated by driving of a lens diaphragm can be reduced by using sound spectrum signals for subtracting the sound. Such non-stationary sound is, for example, detected by the noise detection unit 204 as short-term noise. Alternatively, the sound processing unit 200 may perform processing of decreasing amplitude on a sound spectrum signal having amplitude that is equal to or less than a predetermined threshold to perform suppression processing. Still alternatively, the sound processing unit 200 may perform suppression processing using a bandpass filter, a high-pass filter, or the like, instead of the Wiener filter.

The noise emphasizing unit 205 may use different noise reduction methods depending on types of noise detected by the noise detection unit 204. For example, the noise emphasizing unit 205 may use the Wiener filter in a case of suppressing long-term noise other than the lens driving noise, and use the SS method in a case of suppressing short-term noise other than the lens driving noise.

While the sound processing unit 200 uses the noise emphasizing unit 205 to perform processing of emphasizing noise in a stage prior to that of the correction unit 206 in the present exemplary embodiment, the order may be changed so that the noise emphasizing unit 205 performs the processing of emphasizing noise on signals corrected by the correction unit 206.

The self-noise $NRef_{sn}$ represents data preliminarily measured in a state where the lens driving noise is not generated in the present exemplary embodiment, but may be calculated during recording of sound. For example, the self-noise $NRef_{sn}$ may be an average value of sound spectrum signals in a frame determined to be the frame in the non-noise section by the noise detection unit 204. With this processing, the image pickup apparatus 100 no longer needs to preliminarily measure data. At the same time, even in a case where the self-noise is changed due to aging degradation of a microphone or the like, the image pickup apparatus 100 can use the self-noise $NRef_{sn}$ in accordance with the self-noise.

The sound processing unit 200 may use the correction unit 206 to perform different types of correction processing depending on types of noise detected by the noise detection unit 204.

The correction coefficient used by the correction unit 206 is preliminarily recorded in the present exemplary embodiment, but may be sequentially calculated. For example, the control unit 105 may calculate the correction coefficient using signals acquired with the microphone for external sound 301 and signals acquired with the noise reference microphone 302. For example, an adaptive filtering is used for this calculation.

While the microphone for external sound 301 includes the two microphones in the present exemplary embodiment, the number of microphones is not limited to two. For example, the microphone for external sound 301 may include one microphone in a monaural system, three microphones in a surround system, and four microphones in an ambisonic system.

In the first exemplary embodiment, the method has been described in which the noise emphasizing unit 205 emphasizes noise using only sound spectrum signals generated from sound acquired with the noise reference microphone 302. In a second exemplary embodiment, a method is to be described in which the noise emphasizing unit 205 emphasizes noise further using sound spectrum signals generated from sound acquired with the microphone for external sound 301.

Such a method is especially effective in a case where the noise reference microphone 302 picks up the environmental sound. Such a case occurs when the environmental sound is transmitted through the housing and picked up by the noise reference microphone 302. In the present exemplary embodiment, an example is to be described in which the noise emphasizing unit 205 further suppresses the environmental sound acquired with the noise reference microphone 302 to emphasize the lens driving noise.

In the second exemplary embodiment, a brief description about points different from the first exemplary embodiment is to be mainly given. A configuration of the image pickup apparatus 100 is similar to that of the first exemplary embodiment.

Figure 6:
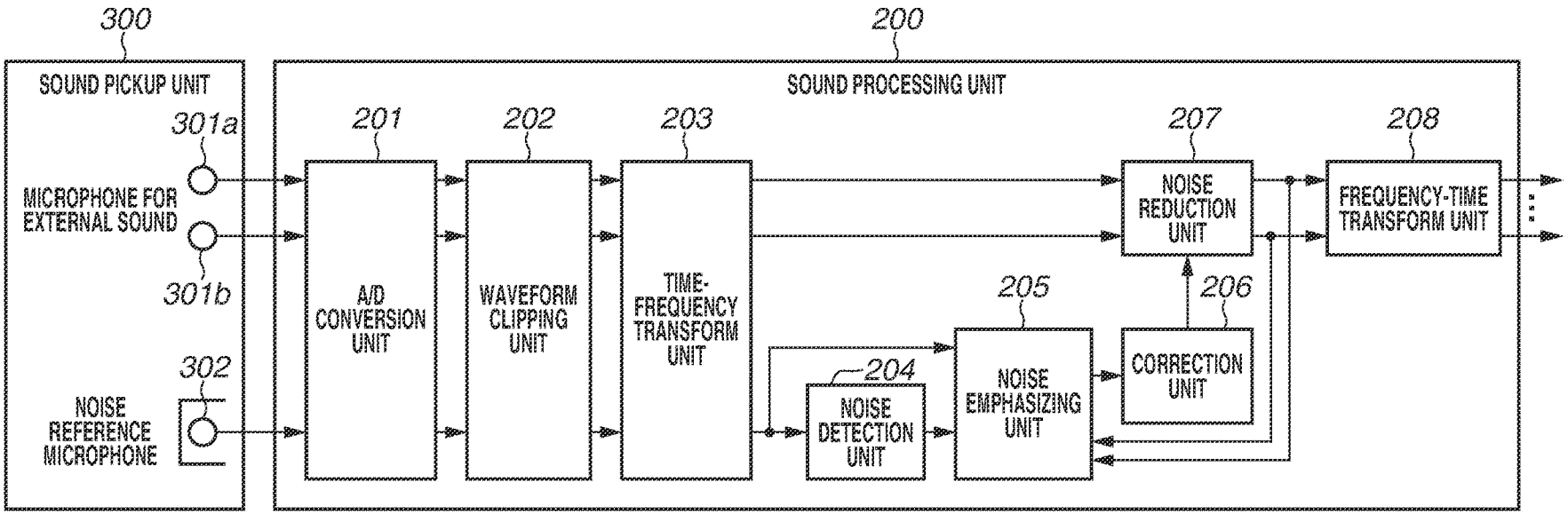
FIG. 6 is an example of a block diagram illustrating the sound processing unit and the sound pickup unit according to one or more aspects of the present disclosure.

In the present exemplary embodiment, in addition to output from the time-frequency transform unit 203 and output from the noise detection unit 204, sound spectrum signals generated from sound acquired with the microphone for external sound 301 are input to the noise emphasizing unit 205, as illustrated in FIG. 6.

In the present exemplary embodiment, the noise emphasizing unit 205 uses, for example, a Wiener filter defined by the expressions (3) and (4).

$$LS(f)=NR(f-1)*G \tag{3}$$

$$WF(f)=NRef_{enh}(f-1)/\{NRef_{enh}(f-1)+LS(f)\} \tag{4}$$

The noise emphasizing unit 205 performs calculation defined by the expression (5) using the Wiener filter defined by the expressions (3) and (4) to implement suppression processing.

$$NRef_{enh}(f)=WF(f)*NRef(f) \tag{5}$$

LS(f) represents amplitude of a sound spectrum signal of the environmental sound acquired with the noise reference microphone 302, and NR(f) represents amplitude of a sound spectrum signal output from the noise reduction unit 207.

G represents a correction coefficient for correcting the sound spectrum signal output from the noise reduction unit 207 to amplitude of the environmental sound acquired with the noise reference microphone 302. The correction coefficient G is a coefficient preliminarily calculated from an actual measured value. Since the other coefficients are similar to those of the first exemplary embodiment, a description of the other coefficients is omitted.

The reason that the sound spectrum signal output from the noise reduction unit 207 is used for the calculation of LS(f) is now described. The sound spectrum signal output from the noise reduction unit 207 can be regarded as sound that does not include the noise driving noise. In the sound spectrum signal in which noise is reduced, the self-noise is not completely eliminated, but the self-noise partially remains. For this reason, the sound spectrum signal output from the noise reduction unit 207 includes the environmental sound and the self-noise, and can be regarded as a sound spectrum signal that does not include noise. That is, LS(f) calculated by correcting the sound spectrum signal output from the noise reduction unit 207 can be regarded as a coefficient that represents amplitude of a sound spectrum signal of the self-noise and the environmental sound. In the expressions of the Wiener filter coefficient described above, LS(f) is regarded as noise, each of the self-noise and the environmental sound is a target of reduction as noise. This is why the sound spectrum signal output from the noise reduction unit 207 is used in the calculation of LS(f).

Consequently, the noise emphasizing unit 205 can suppress the amplitude of the sound spectrum that is output from the noise reduction unit 207 and that includes the self-noise and the environmental sound by using the Wiener filter. That is, the noise emphasizing unit 205 can emphasize the lens driving noise by using the sound spectrum signal output from the noise reduction unit 207.

The image pickup apparatus 100 performs the noise reduction processing using the sound spectrum signal output from the noise emphasizing unit 205, and can thereby reduce a larger amount of noise and generate high-quality sound.

In the calculation of NR(f), the noise emphasizing unit 205 may use a sound spectrum signal generated from sound acquired with at least one of the microphones included in the microphone for external sound 301.

While the method has been described in which the noise emphasizing unit 205 uses the sound spectrum signals output from the noise reduction unit 207 for the calculation of LS(f), the noise emphasizing unit 205 may use other sound spectrum signals. For example, the noise emphasizing unit 205 may use sound spectrum signals obtained by performing masking processing on sound spectrum signals generated from sound acquired with the microphone for external sound 301 using a mask for reducing the lens driving noise that is preliminarily prepared. For example, the noise emphasizing unit 205 may use sound spectrum signals obtained by reducing the lens driving noise from sound spectrum signals generated from sound acquired with the microphone for external sound 301 using a band-stop filter.

The present disclosure can be achieved by installing a program that implements one or more functions of the exemplary embodiments described above in a system or an apparatus through a network or a storage medium, and one or more processors in the system or a computer of the apparatus loading and executing the program. Furthermore, the present disclosure can also be achieved by a circuit (e.g., application-specific integrated circuit (ASIC)) that implements one or more functions.

The present disclosure is not limited to the above-mentioned exemplary embodiments as they are, and can be embodied by modifying components without departing from the gist of the present disclosure in an implementation phase. Appropriate combinations of components discussed in the above-mentioned exemplary embodiments can form various kinds of disclosures. For example, some components may be eliminated from the entire components discussed in the exemplary embodiments. Furthermore, components that are described in the different exemplary embodiments may be combined as appropriate.

According to the present disclosure, it is possible to perform noise reduction processing that can prevention of degradation of sound quality and the like while reducing lens driving noise.

Other Embodiments

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, the scope of the following claims are to be accorded the broadest interpretation so as to encompass all such modifications and equivalent structures and functions.

This application claims the benefit of Japanese Patent Application No. 2021-050221, filed Mar. 24, 2021, which is hereby incorporated by reference herein in its entirety.

What is claimed is:

1. A sound processing apparatus comprising:

a first microphone which acquires environmental sound and outputs a first sound signal;

a second microphone which acquires sound of a noise source and outputs a second sound signal; and a CPU which executes a program stored in a memory to cause the sound processing apparatus to function as:

a noise detection unit configured to generate a noise signal of the noise source according to the second sound signal from the second microphone, wherein the noise detection unit is configured to reduce sound other than noise of the noise source from the second sound signal output from the second microphone to generate the noise signal, and a noise reducing unit configured to reduce the noise of the noise source included in the first sound signal output from the first microphone using the noise signal generated by the noise detection unit.

2. The sound processing apparatus according to claim 1, wherein the sound other than the noise of the noise source includes at least one of environmental sound, self-noise of the first microphone, or self-noise of the second microphone.

3. The sound processing apparatus according to claim 1, wherein the noise detection unit is configured to reduce sound that is not correlated to the noise of the noise source from the second sound signal output from the second microphone.

4. The sound processing apparatus according to claim 1, wherein the noise detection unit is configured to perform different types of processing of reducing sound other than the noise of the noise source from the second sound signal according to types of sound other than the noise of the noise source.

5. The sound processing apparatus according to claim 1, wherein the noise detection unit is configured to subtract the sound other than the noise of the noise source from the second sound signal.

6. The sound processing apparatus according to claim 1, wherein the noise detection unit is configured to reduce the sound other than the noise of the noise source from the second sound signal using a filter.

7. The sound processing apparatus according to claim 6, wherein the noise detection unit is configured to reduce the sound other than the noise of the noise source from the second sound signal using a Wiener filter.

8. The sound processing apparatus according to claim 1, wherein the CPU further causes the sound processing apparatus to function as a detection unit configured to detect a period in which the noise is generated from the noise source, wherein the noise detection unit is configured to emphasize the noise of the noise source included in the second sound signal in the period detected by the detection unit in which the noise is generated from the noise source.

9. The sound processing apparatus according to claim 8, wherein the detection unit is configured to detect the period in which the noise is generated from the noise source based on the second sound signal.

10. The sound processing apparatus according to claim 1, wherein the noise detection unit corrects the noise signal, and wherein the noise reducing unit is configured to subtract the corrected noise signal from the first sound signal output from the first microphone.

11. The sound processing apparatus according to claim 1, wherein the CPU further causes the sound processing apparatus to function as a transform unit configured to transform the first sound signal output from the first microphone in a time domain, and the second sound signal output from the second microphone in a time domain to sound signals in a frequency domain, wherein the noise detection unit is configured to perform emphasize processing of emphasizing the noise of the noise source out of the second sound signal transformed by the transform unit, and wherein the noise reducing unit is configured to subtract the second sound signal to which the emphasize process is performed from the first sound signal transformed by the transform unit.

12. The sound processing apparatus according to claim 1, wherein the noise source is included in a lens attachable to the sound processing apparatus.

13. A control method of a sound processing apparatus including a first microphone for environmental sound, and a second microphone for sound from a noise source, the control method comprising:

generating a noise signal using a second sound signal output from the second microphone, wherein the generating reduces sound other than noise of the noise source from the second sound signal to generate the noise signal; and reducing the noise of the noise source from a first sound signal output from the first microphone using the noise signal.

14. A non-transitory storage medium storing a program to cause a sound processing apparatus to execute a control method, the sound processing apparatus including a first microphone for environmental sound, and a second microphone for sound from a noise source, the control method comprising:

generating a noise signal using a second sound signal output from the second microphone, wherein the generating reduces sound other than noise of the noise source from the second sound signal to generate the noise signal; and reducing the noise of the noise source from a first sound signal output from the first microphone using the noise signal.

* * * * *